United States Patent [19]

Krockow

[11] Patent Number: 4,589,260

[45] Date of Patent: May 20, 1986

[54] PRE-MIXING BURNER WITH INTEGRATED DIFFUSION BURNER

[75] Inventor: Wolfram Krockow, Düsseldorf, Fed. Rep. of Germany

[73] Assignee: Kraftwerk Union Aktiengesellschaft, Mülheim, Fed. Rep. of Germany

[21] Appl. No.: 549,317

[22] Filed: Nov. 4, 1983

[30] Foreign Application Priority Data

Nov. 8, 1982 [DE] Fed. Rep. of Germany ..... 3241162

[51] Int. Cl.[4] ..... F02C 1/00; F02G 3/00

[52] U.S. Cl. ..... 60/737; 60/748

[58] Field of Search ..... 60/732, 733, 737, 748, 60/39.281

[56] References Cited

U.S. PATENT DOCUMENTS

| | | | |
|---|---|---|---|
| 2,850,875 | 9/1958 | Gahwyler | 60/748 |
| 3,048,014 | 8/1962 | Schmidt | 60/39.281 |
| 3,853,273 | 12/1974 | Bahr et al. | 60/748 |
| 3,886,728 | 6/1975 | Quinn | 60/737 |
| 3,905,192 | 9/1975 | Pierce et al. | 60/748 |
| 4,021,188 | 5/1977 | Yamagishi et al. | 60/732 |
| 4,073,134 | 2/1978 | Koch | 60/748 |
| 4,222,232 | 9/1980 | Robinson | 60/737 |
| 4,356,698 | 11/1982 | Chamberlain | 60/737 |
| 4,408,461 | 11/1983 | Bruhwiler et al. | 60/737 |

FOREIGN PATENT DOCUMENTS

| | | | |
|---|---|---|---|
| 3238684 | 4/1984 | Fed. Rep. of Germany | 60/737 |
| 894054 | 4/1962 | United Kingdom | 60/748 |
| 2073399 | 10/1981 | United Kingdom | 60/737 |

*Primary Examiner*—Louis J. Casaregola
*Assistant Examiner*—Timothy S. Thorpe
*Attorney, Agent, or Firm*—Herbert L. Lerner; Laurence A. Greenberg

[57] ABSTRACT

Burner system for gas turbine combustion chambers having a pre-mixing burner with an integrated diffusion burner, where: the pre-mixing burner has a pre-mixing chamber bounded at the downstream end by a flame retention baffle, into which chamber a main fuel nozzle and a feeding device for combustion air open; the diffusion burner has a pilot fuel nozzle arranged in the central region of the flame retention baffle; and where a fuel control device controls the total amount and the partial amounts of the fuel fed to the main fuel nozzle and the pilot fuel nozzle as a function of the load of the gas turbine such that the diffusion burner can be operated exclusively until the idling speed or a small partial load is reached, and thereafter the diffusion burner and the pre-mixing burner can be operated together, characterized especially by the fact that the entire combustion air required for the operation of the diffusion burner can be fed-in exclusively via the pre-mixing chamber, and that the fuel control device controls the total amount and the partial amounts of the fuel supplied such that the pre-mixing burner can be operated exclusively in the upper load range.

10 Claims, 6 Drawing Figures

PRE-MIXING BURNER WITH INTEGRATED DIFFUSION BURNER

BACKGROUND OF THE INVENTION

1. Field of the Invention

The invention relates to a burner system including a pre-mixing burner with an integrated diffusion burner for gas turbine combustion chambers.

2. Description of the Prior Art

The combustion of gaseous or liquid fuels in gas turbine combustion chambers produces as pollutants in the gas, among other things, the nitrogen oxides NO and $NO_2$ which together are designated as $NO_x$. The $NO_x$-content in the exhaust gas is to be kept as low as possible; in the USA, for instance, a limit of 75 ppm at 15% by volume $O_2$ must not be exceeded according to environment protection regulations. Complying with these regulations presents great difficulties particularly if conventional diffusion burners are used in the gas turbine combustion chambers. In such diffusion burners the fuel is introduced directly via a fuel nozzle into the combustion zone and is mixed there with the combustion air, where the combustion is controlled by turbulent diffusion processes between the fuel, the combustion air and the exhaust gas products. A relatively high $NO_x$-content in the exhaust gas is obtained due to large temperature differences with high temperature peaks produced by local areas of different mixing ratios of fuel and combustion air. German Published Non-Prosecuted Application DE-OS No. 29 50 535 relating to gas turbine combustion chamber discloses so-called pre-mixing and pre-evaporation of the liquid fuel fed-in through fuel nozzles and/or the pre-mixing of the gaseous fuel fed-in through fuel nozzles with the combustion air takes place with a large excess air number. Pre-mixing avoids local spots or areas of different mixing ratios of fuel and combustion air in the combustion. On the other hand, such premixing burners have a substantially smaller operating range than conventional diffusion burners, i.e., the mixing ratios of the fuel and the combustion air must be kept within relatively narrow limits. If the fuel content is too high, too much $NO_x$ is formed, and if there is too little fuel, the combustion is extinguished. The fuel lines of the individual pre-mixing burners are therefore equipped with valves so that, as a function of the load of the gas turbine, only as many pre-mixing burners are supplied with fuel, as can be kept within the narrow limits of the mixing ratios for the operation. In addition, several conventional diffusion burners are provided which serve for starting up the gas turbine and are subsequently switched off again.

German Published Non-Prosecuted Application DE-OS No. 26 13 589 discloses hybrid burners for gas turbine combustion chambers which consist of pre-mixing burners with integrated diffusion burners. The pre-mixing burner has a pre-mixing chamber which is confined at the down-stream end by a flame retention baffle and into which a main fuel nozzle and a feed device for combustion air open. The diffusion burner has a pilot fuel nozzle which is arranged in the central zone of the flame retention baffle, where the combustion air for the operation of the diffusion burner is fed-in in part through the pre-mixing chamber of the pre-mixing burner and in part through holes arranged in the flame retention baffle of the gas turbine combustion chamber. In addition, a fuel control device is provided which controls the total amount and the partial amounts of the fuel fed to the main fuel nozzle and the pilot fuel nozzle as a function of the load of the gas turbine in such that, until the idling speed or a small partial load is reached, the diffusion burner can be operated exclusively, and thereafter, the diffusion burner and the pre-mixing burner operate together. Such hybrid burners therefore have the advantage that separate starting burners designed as diffusion burners can be dispensed with in a space-saving, compact design. In addition, the flame of the diffusion burner supports the combustion of the mixture of fuel and combution air generated in the pre-mixing chamber, i.e., the flame of the pre-mixing burner can be ignited reliably with mixing ratios extremely lean in view of low $NO_x$ development. The hybrid burner can, therefore, be operated over a wide load range with low $NO_x$-content in the exhaust gas. However, an undesirable rise of the $NO_x$-development in the upper load range and especially at the load limit is noted.

SUMMARY OF THE INVENTION

It is an object of the invention to provide a burner system with a pre-mixing burner with an integrated diffusion burner for gas turbine combustion chambers with little $NO_x$-development in the exhaust gas over the entire load range of the gas turbine operation.

With the foregoing and other objects in view, there is provided in accordance with the invention a burner system for a gas turbine combustion chamber comprising (a) a pre-mixing burner with an integrated diffusion burner (b) the pre-mixing burner having a pre-mixing chamber into which chamber a main fuel nozzle and a feeding device for combustion air open, and which chamber is bounded at its downstream end by a flame retention baffle (c) the diffusion burner having a pilot fuel nozzle arranged in the central region of the flame retention baffle, (d) a fuel control device which controls the total amount and the partial amounts of fuel fed to the main fuel nozzle and the pilot fuel nozzle as a function of the load of the gas turbine to permit the diffusion burner to be operated exclusively until the idling speed or a small partial load of the gas turbine is reached, and thereafter permitting the diffusion burner and the pre-mixing burner to be operated together (e) the entire combustion air required for the operation of the diffusion burner is fed-in exclusively via the pre-mixing chamber (f) the fuel control device controls the total amount and the partial amounts of the fuel supplied to the nozzles to permit the pre-mixing burner to be operated exclusively in the upper load range of the gas turbine.

Other features which are considered as characteristic for the invention are set forth in the appended claims.

Although the invention is illustrated and described herein as embodied in a pre-mixing burner with integrated diffusion burner, it is nevertheless not intended to be limited to the details shown, since various modification may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

FIG. 1 shows a burner system with a hybrid burner of a pre-mixing burner with an integrated diffusion burner, a pre-mixing chamber, a swirling device, a flame retention baffle, a main fuel nozzle, a pilot fuel nozzle, a flame tube, a fuel tank, and a control device controlling fuel fed-in.

DETAILED DESCRIPTION OF THE INVENTION

Figure 1:
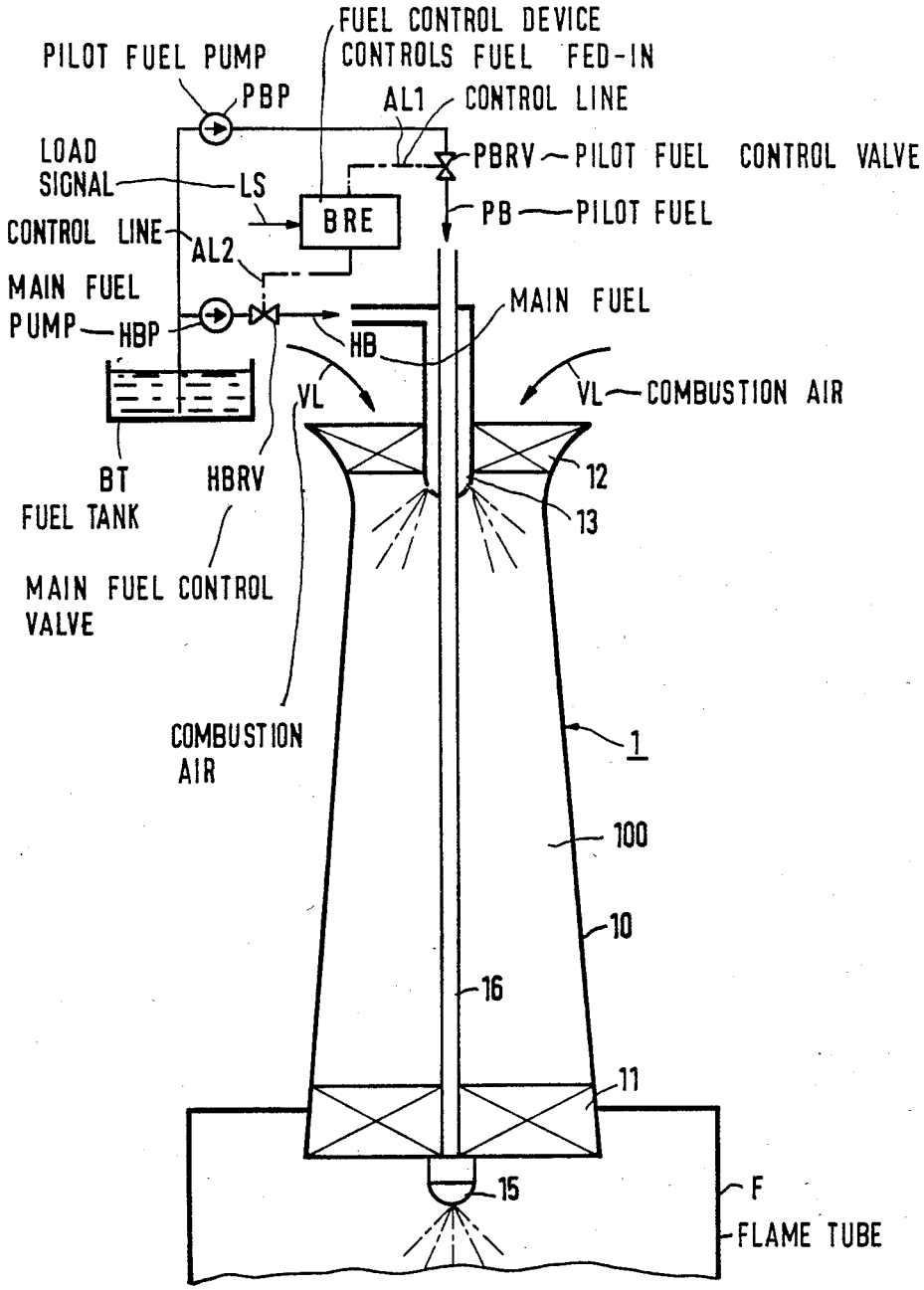

The invention is based on the insight that the $NO_x$-development can be reduced substantially if the pre-mixing burner is operated alone in the upper load range, and that the operation of the premixing burner alone, however, is possible in the upper load range only if the entire combustion air available is fed-in exclusively via the pre-mixing chamber.

Particular features which characterize the invention are (a) the entire combustion air required for the operation of the diffussion burner can be fed-in exclusively via the pre-mixing chamber, and (b) the fuel control device controls the total amount and the partial amounts of the fuel supplied such that the pre-mixing burner can be operated exclusively in the upper load range of the gas turbine.

According to a further embodiment of the invention, the fuel control device from the point of reaching the idling speed or a small partial load, reduces the partial amount of the fuel fed to the pilot fuel nozzle with increasing load. The $NO_x$-development caused by the operation of the diffusion burner is then reduced more than the $NO_x$-development additionally caused by the operation of the pre-mixing burner with a correspondingly increased amount of fuel. The support of the flame of the pre-mixing burner is fully assured, however.

The fuel control device can also be associated with additional pre-mixing burners having integrated diffusion burners. The total expense for valves required for a gas turbine combustion chamber can thereby be reduced substantially.

Alternative operation with gaseous and/or liquid fuel is made possible by providing the pre-mixing burner with a first main fuel nozzle for gaseous fuel and a second main fuel nozzle for liquid fuel. Similarly, the diffusion burner can also have a first pilot fuel nozzle for gaseous fuel and a second pilot fuel nozzle for liquid fuel.

The integration of the diffusion burner into the pre-mixing burner can be accomplished at particularly low expense by passing the fuel feed line to the pilot fuel nozzle through the pre-mixing chamber centrally and in the axial direction. If the diffusion burner is operated with gaseous and/or liquid fuel, then the fuel feed lines to the first pilot fuel nozzle and to the second pilot fuel nozzle go through the pre-mixing chamber as concentric tubes centrally and in the axial direction.

If the pre-mixing burner is also to be operated with gaseous and/or liquid fuel, an especially compact design can be obtained by making the fuel feed lines to the two main fuel nozzles and the two pilot fuel nozzles as concentric tubes.

In a further preferred embodiment of the invention the feeding device for combustion air leading into the pre-mixing chamber is designed as a swirling device. This further favors the intensive mixing of combustion air and fuel in the pre-mixing chamber. The swirling device can also be designed as a main fuel nozzle. This is accomplished by making several fuel injection holes in each of the vanes designed as hollow blades. A particularly intensive atomization and pre-evaporation of liquid fuel in the combustion air can also be obtained if the pre-mixing chamber has a venturi-like contour with a section converging at the upstream end and a diverging section at the downstream end.

If the pre-mixing burner as well as the diffusion burner can be operated with gaseous and/or liquid fuel, the fuel feed lines, the main fuel nozzles and the two pilot fuel nozzles can be combined in a component which can be pulled out of the premixing chamber in the axial direction. This substantially simplifies the assembly, maintenance and inspection.

Embodiment examples of the invention are shown in the drawing and will be described in detail in the following.

FIG. 1 shows in a greatly simplified schematic view a longitudinal section through a hybrid burner which is designated as a whole with 1 and can be operated as a pre-mixing burner and/or diffusion burner. The hybrid burner 1 comprises a burner housing 10 which has a flame retention baffle 11 at the end-face of one end and a swirling device 12 at the other end-face of the other end. Flame retention baffles and swirling devices are known in the art. A main fuel nozzle 13 is arranged in the central region of the swirling device 12. Fuel can be fed through the fuel feed line designated 14 (shown in FIG. 2). A pilot fuel nozzle 15 is arranged in the central region of the flame retention baffle 11. The pilot fuel feed line 16 goes through the main fuel nozzle 13 and the burner housing centrally and in the axial direction.

If the hybrid burner 1 is operated as a pre-mixing burner, the liquid main fuel indicated by an arrow HB is transported from a fuel tank BT via a main fuel pump HBP and a main fuel control valve HBRV into the fuel feed line 14 of the main fuel nozzle 13. The main fuel HB from the main fuel nozzle 13 is then injected in finely distributed form into a pre-mixing chamber 100 which is bounded by the burner housing 10, the flame retention baffle 11 and the swirling device 12. In this pre-mixing device 100, the main fuel HB is evaporated and mixed with the combustion air VL fed-in via the swirling device 12. This mixing and the pre-evaporation are promoted by the venturi-like contour of the burner housing 10. The combustion of the homogeneous mixture, formed in the pre-mixing chamber 100, of the main fuel HB and the combustion air VL then takes place only in the flame tube F of a gas turbine combustion chamber, otherwise not shown in detail. The flame retention baffle 11 which serves to stabilize the flame in the gas turbine combustion chamber, nevertheless prevents the flame from backfiring into the pre-mixing chamber 100.

If the hybrid burner 1 is operated as a diffusion burner, the pilot fuel indicated by an arrow PB is transported from the fuel tank BT via a pilot fuel pump PBP and a pilot fuel control valve PBRV into the fuel feed line 16 of the pilot fuel nozzle 15. Final control valves are known in the art. The pilot fuel PB from the pilot fuel nozzle 15 is then injected in finely distributed form directly into the combustion zone of the flame tube F and is mixed there with the combustion air VL fed-in exclusively via the swirling device 12, the pre-mixing chamber 100 and the flame retention baffle 11. The combustion in flame tube F is controlled by turbulent combustion processes between the pilot fuel PB, the combustion air VL and the exhaust gas products.

In the operation of the hybrid burner 1, the total amount of the fed-in fuel and the partial amounts fed-in as pilot fuel PB and as main fuel HB are controlled via a fuel control device BRE as a function of the load of the gas turbine. Fuel control devices operating in response to another factor are known in the art. The fuel control device BRE which is addressed by a corresponding load signal LS, controls the flow of fuel through the pilot fuel control valve PBRV and the main fuel control valve HBRV via corresponding addressing lines AL1 and AL2 such that the diffusion burner can be operated exclusively until the idling speed or a small partial load is reached, that thereafter the diffusion burner and the pre-mixing burner can be operated together; and that in the upper load range, the pre-mixing burner can be operated exclusively.

The flame tube F shown in FIG. 1 may be, for instance, the flame tube of a primary combustion chamber. The gas turbine combustion chamber may have a multiplicity of such primary combustion chambers which open into a common mixing chamber. Due to the large operating range of the hybrid burners 1, separate control and load-dependent switching on and off of individual primary combustion chambers can be eliminated and the fuel control device BRE, the pilot fuel control valve PBRV and the main fuel control valve HBRV can be combined for all hybrid burners 1 of the gas turbine combustion chamber. However, such a common fuel control device may also be employed if a multiplicity of hybrid burners lead into the flame tube of a gas turbine combustion chamber. This case is illustrated in FIG. 2 where, however, only three hybrid burners 1 are shown for simplifying the graphic presentation.

Figure 2:
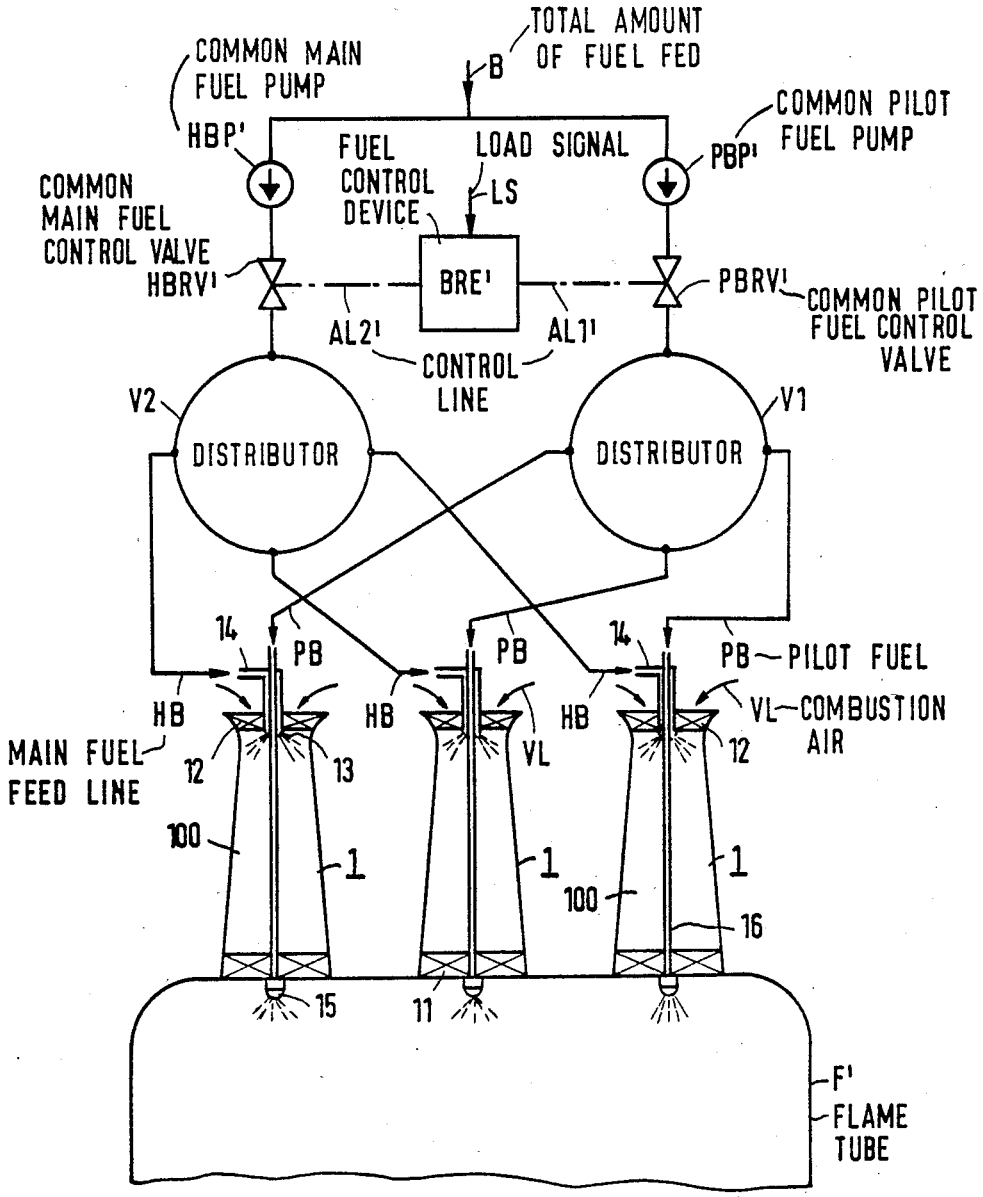
FIG. 2 shows a burner for a gas turbine combustion chamber with several hybrid burners.

Accordingly, three hybrid burners 1 can be seen in FIG. 2 which open into the flame tube F' of a gas turbine combustion chamber, not shown in detail. In the region of the combustion zone, the flame tube F' has no openings for the admission of combustion air, since the total combustion air VL available is fed exclusively to the mixing chamber 100 of the hybrid burners 1. This does not exclude, however, openings for admitting mixing air in the flame tube F' downstream from the combustion zone.

The pilot fuel PB derived from the total amount of fuel fed-in flows via a common pilot fuel pump PBP', a common pilot fuel control valve PBRV' and a distributor V1 shown as a circle. The individual streams of pilot fuel PB from distributor VI are introduced into fuel feed lines 16 leading to pilot fuel nozzles 15 of the individual hybrid burners 1.

The main fuel HB flows to the main fuel feed lines 14 leading to the main fuel nozzles 13 of the individual hybrid burners 1 via a common main fuel pump HBP', a common main fuel control valve HBRV' and a distributor V2 shown as a circle.

In the operation of the gas turbine combustion chamber, the total amount of the fuel B fed to the hybrid burners 1 and the total partial amounts fed-in as pilot fuel PB and as main fuel HB, respectively, are controlled via a fuel control device BRE' as a function of the load of the gas turbine. The fuel control device BRE' which is acted upon by a corresponding load signal LS, controls the flow of fuel through the common pilot fuel control valve PBRV' and the common main fuel control valve HBRV' via corresponding addressing lines AL1' and AL2' such that the diffusion burners can be operated exclusively until the idling speed or a small partial load is reached: that thereafter the diffusion burners and the pre-mixing burners can be operated together; and that the pre-mixing burners can be operated exclusively in the upper load range of the gas turbine.

Figure 3:
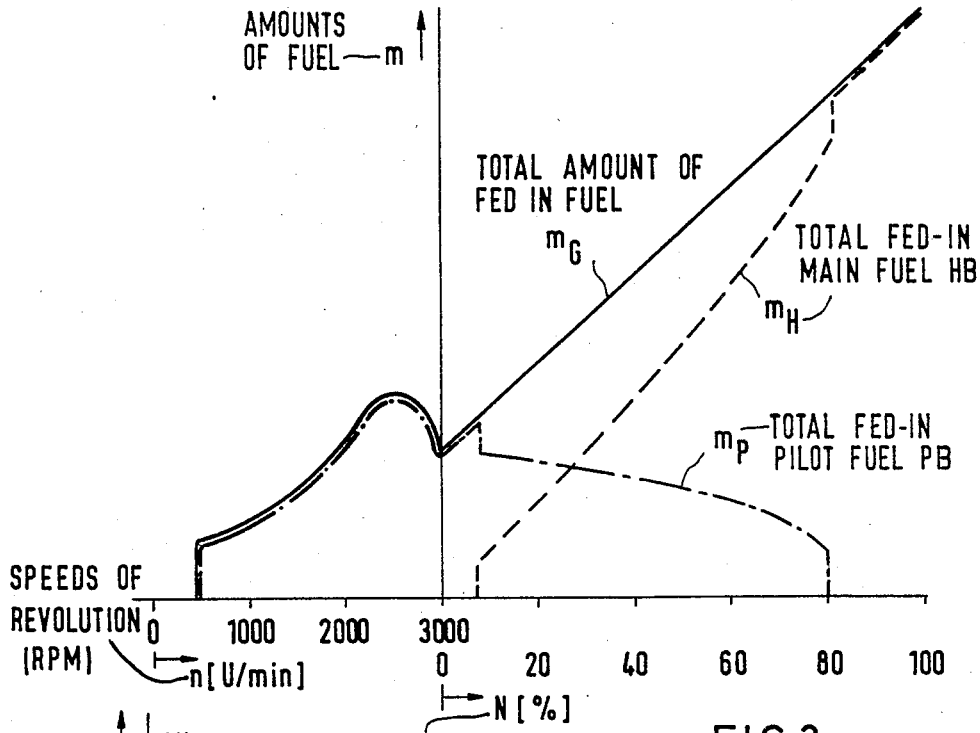
FIG. 3 is a diagram in which the total amount and the partial amounts of the fuel fed to the main fuel nozzle and the pilot fuel nozzle are shown as a function of the load of the gas turbine.

The mode of operation described above can be seen in still greater detail in the diagram of FIG. 3. On the right-hand branch of the abscissa are shown the output power N of the gas turbine up to the load limit in percent, on the left-hand branch of the abscissa the speeds of revolution n up to the idling speed in RPM and on the ordinate, the amounts of fuel m. The solid curve shows the total amount $m_G$ of the fed-in fuel B (see FIG. 2); the dash-dotted curve, the amount $m_P$ of the total fed-in pilot fuel PB (see FIG. 2); and the dashed curve, the amount $m_H$ of the total fed-in main fuel HB (see FIG. 2). It can be seen that upon starting the gas turbine, the diffusion burners are switched-on from a low speed on, and pilot fuel PB (see FIG. 2) is supplied exclusively until the idling speed n=3000 RPM is reached. The exclusive operation of the diffusion burners is contineud briefly after the idling speed is reached until, under a small partial load, the pre-mixing burners are added and are supplied with an increasing amount $m_H$ of main fuel HB (see FIG. 2). After the pre-mixing burners are added, the amount $m_P$ of the pilot fuel PB (see FIG. 2) fed to the diffusion burners is reduced. In the upper load range, the diffusion burners are then switched off completely and only the pre-mixing burners are operated, i.e., only main fuel HB is fed-in (see FIG. 2).

The upper load range, in which the diffusion burners are switched off and only the pre-mixing burners are operated, is, in the embodiment example shown, between N=80% and the load limit with N=100%. The upper load range, in which the diffusion burners are disconnected, could also be defined as the region between the flame stability limit and the desired $NO_x$-limit at the load limit. The diffusion burners are switched off only if the pre-mixing burners can burn alone without the assistance of the flame of the diffusion burners and without the danger of going out.

Figure 4:
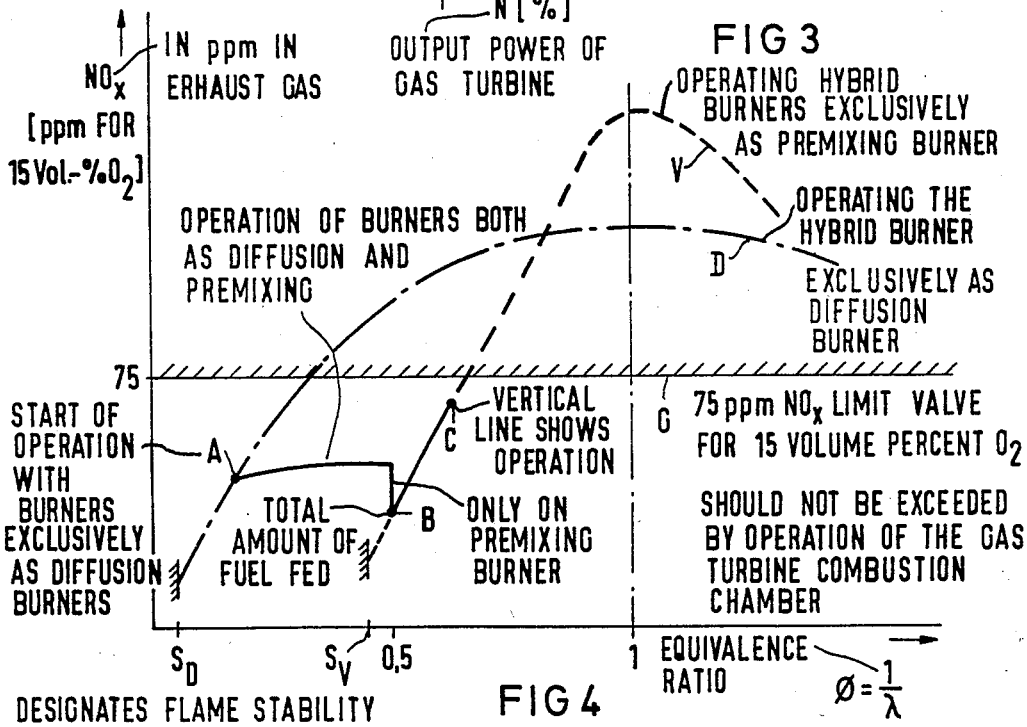
FIG. 4 is a diagram in which the $NO_x$-content in the exhaust gas is plotted versus the equivalence ratio.

The $NO_x$-emission in the operation of the gas turbine combustion chamber shown in FIG. 2 can be seen from the diagram of FIG. 4. There, the equivalence ratio $\phi=1/\lambda$ is plotted on the abscissa, where $\lambda$ is the excess air number. On the ordinate is plotted the $NO_x$-content in the exhaust gas in ppm for 15 volume percent $O_2$. The straight line G running parallel to the abscissa indicates an $NO_x$-limit value of 75 ppm for 15 volume percent $O_2$, which must not be exceeded in the operation of the gas turbine combustion chamber.

If the hybrid burners 1 of the gas turbine combustion chamber shown in FIG. 2 are operated exclusively as diffusion burners, an $NO_x$-content in the exhaust gas according to the dash-dotted line D is obtained while, with the exclusive operation of a pre-mixing burner, an $NO_x$-content in the exhaust gas according to the dashed curve V is obtained. $S_D$ and $S_V$ designates the flame stability limits, at which a diffusion burner or a pre-mixing burner just still burn with stability.

It can further be seen that in operation as a diffusion burner as well as in operation as a pre-mixing burner, a maximum of the $NO_x$-content in the exhaust gas appears at an equivalence ratio of $\phi=1$.

Upon starting the gas turbine combustion chamber shown in FIG. 2, the hybrid burners 1 are operated exclusively as diffusion burners until a small partial load is reached, the $NO_x$-content in the exhaust gas being given during this phase of the operation by point A on the curve D. Thereafter, the hybrid burners 1 are operated as diffusion burners and at the same time as pre-mixing burners, the $NO_x$-content in the exhaust gas being given during this operating phase by the heavy solid curve AB. The last vertical section of the curve AB illustrates the dropping of the $NO_x$-content in the exhaust gas after the diffusion burners are completely shut off. Accordingly, point B is located above the flame stability limit $S_V$ on the curve V. After the diffusion burners are turned off, the hybrid burners 1 are then operated in the upper load range exclusively as pre-mixing burners, where the $NO_x$-content in the exhaust gas is indicated by the heavy solid section BC of the curve V. Point C corresponds to the maximum value of the $NO_x$-content in the exhaust gas reached at the load limit, where this maximum value, however, is still distinctly below the permissible $NO_x$-limit G. The point C is therefore also the design point of the gas turbine combustion chamber which determines the total number of hybrid burners 1 required.

Figure 5:
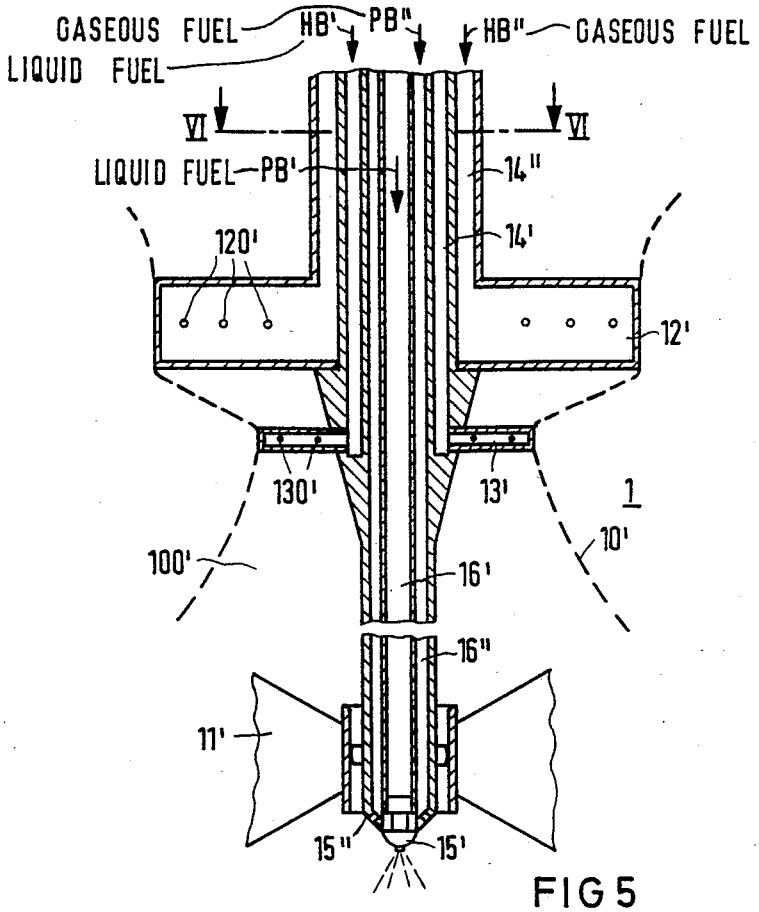
FIG. 5 is a hybrid burner in which the pre-mixing burner as well as the diffusion burner can be operated with gaseous and/or liquid fuel.
Figure 6:
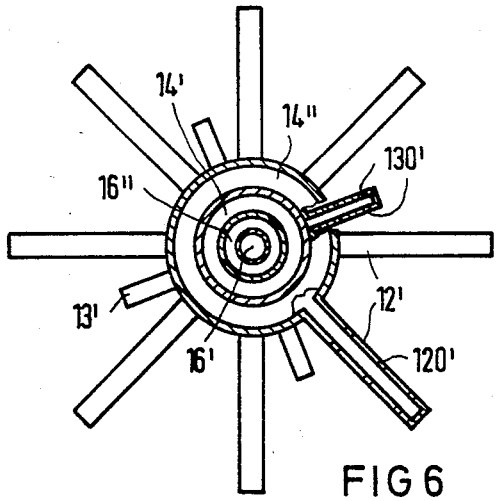
FIG. 6 is a cross section of the hybrid burner taken along line VI—VI of FIG. 5.

FIGS. 5 and 6 show a hybrid burner which can be operated with gaseous and/or liquid fuel, in a longitudinal and cross section, respectively, shown only partially. The hybrid burner 1' has a burner housing which is indicated by the dashed line 10' and has a Venturi-like contour. The pre-mixing chamber 100' formed by the burner housing 10' is bonded at its downstream end by a flame retaining baffle 11' only indicated in the drawing, and at its upstream end by a swirling device 12'. The swirling device 12' also forms a first main fuel nozzle for gaseous fuel, for which purpose several fuel injection holes 120' are placed in the respective individual vanes designed as hollow blades. The gaseous fuel indicated by an arrow HB'' is fed-in through a fuel feed line 14'', on which are placed the vanes designed as hollow blades of the swirling device 12'. A second main fuel nozzle 13' of liquid fuel is arranged at a small distance downstream from the swirling device 12'. Second main fuel nozzle 13' likewise has vanes which are designed as hollow blades and in which several fuel injection holes 130' are made. The supply of the liquid fuel indicated by arrows HB' to the fuel injection holes 130' takes place via a fuel feed line 14' which is arranged concentrically within the fuel feed line 14''. The vanes of the second main fuel nozzle 13' designed as hollow blades are placed on fuel feed line 14'.

In the central region of the flame retention baffle 11' are arranged a first pilot fuel nozzle 15'' for gaseous fuel and a second pilot fuel nozzle 15' for liquid fuel. The gaseous fuel indicated by an arrow PB'' is fed to the first pilot fuel nozzle 15'' via a fuel feed line 16'' which runs initially concentrically within the fuel feed line 14' and then goes through the pre-mixing chamber 100' centrally and in the axial direction. The liquid fuel indicated by an arrow PB' is fed to the second pilot fuel nozzle 15' via a fuel feed line 16' which is arranged concentrically inside the fuel feed line 16''.

The four fuel feed lines 14'', 14', 16'', 16', the swirling device 12' which is also designed as the first main fuel nozzle, the second main fuel nozzle 13', the first pilot fuel nozzle 15'' and the second pilot fuel nozzle 15' are combined in a component, i.e. as a unit, which can be pulled out of the burner housing 10' and the flame retention baffle 11' in the axial direction to facilitate servicing and inspection.

In the cross section of FIG. 6, the concentric arrangement of the individual fuel feed lines 14'', 14', 16'' and 16' can be seen clearly. It can also be seen that the vanes of the swirling device 12' oriented in star-fashion and the vanes of the second main fuel nozzle 13' oriented in star-fashion are arranged offset relative to each other as seen in the circumferential direction. A particularly intensive atomization and pre-evaporation of the liquid fuel HB' issuing from the fuel injection holes 130' in the combustion air fed-in via the swirling device 12' are obtained since the second main fuel nozzle 13' is additionally further arranged in the vicinity of the smallest cross section of the Venturi-like contour of the burner housing 10'.

The operation of the hybrid burner 1' shown in FIGS. 5 and 6 corresponds to the operation of the hybrid burner shown in FIGS. 1 and 2; however, a fuel control device each is provided for the liquid fuels PB' and HB' and for the gaseous fuels PB'' and HB''. If the hybrid burner 1' is to be operated simultaneously with liquid and gaseous fuel, these two fuel control devices must be interlinked in accordance with the mode of operation shown in FIG. 3.

The foregoing is a description corresponding, in substance, to German application No. P 32 41 162.6, dated Nov. 8, 1982, international priority of which is being claimed for the instant application, and which is hereby made part of this application. Any material discrepancies between the foregoing specification and the specification of the aforementioned corresponding German application are to be resolved in favor of the latter.

I claim:

1. Burner system for a gas turbine combustion chamber comprising (a) a pre-mixing burner with an integrated diffusion burner (b) the pre-mixing burner having a pre-mixing chamber into which chamber a main fuel nozzle and a feeding device for combustion air open, and which chamber is bounded at its downstream end by a flame retention baffle (c) the diffusion burner having a pilot fuel nozzle arranged in the central region of the flame retention baffle, (d) fuel control means including a load signal device which generates a signal in accordance with the load of the gas turbine, a fuel control device connected to and operating in response to the load signal device, a main fuel control valve through which fuel flows to the main fuel nozzle, a pilot fuel control valve through which fuel flows to the pilot fuel nozzle, said fuel control device connected to the main fuel control valve and to the pilot fuel control valve and operating in response to the load signal device controls the flow of fuel through the pilot fuel control valve exclusively from start of the gas turbine to a low load or idling speed or a small partial load of the gas turbine and thereafter to an upper range load of the gas turbine through both the main fuel control valve and the pilot fuel control valve, (e) said opening in the pre-mixing chamber for the feeding device for combustion air being the sole entrance for the entire combustion air required for the operation of the diffusion burner, and (f) said fuel control device connected to the main fuel control valve and to the pilot fuel control valve and operating in response to the load signal device above the upper range load of the gas turbine controls the flow of fuel through the main fuel control valve exclusively.

2. Burner system according to claim 1, wherein the fuel control device is associated with additional pre-mixing burners with integrated diffusion burners.

3. Burner system according to claim 1, wherein the pre-mixing burner comprises a first main fuel nozzle for gaseous fuel and a second main fuel nozzle for liquid fuel.

4. Burner system according to claim 1, wherein the diffusion burner comprises a first pilot fuel nozzle for gaseous fuel and a second pilot fuel nozzle for liquid fuel.

5. Burner system according to claim 4, wherein the fuel feed lines leading to the first pilot fuel nozzle and to the second pilot fuel nozzle go through the pre-mixing chamber as concentric tubes centrally and in the axial direction.

6. Burner system according to claim 3, wherein the fuel feed lines leading to the two main fuel nozzles and to the two pilot fuel nozzles are concentric tubes.

7. Burner system according to claim 1, wherein the swirling device has vanes in the form of hollow blades, and the swirling device acts as the main fuel nozzle by means of several fuel injection holes made in each of the hollow blades.

8. Burner system according to claim 6, wherein the fuel feed lines, the two main fuel nozzles and the two pilot fuel nozzles are combined as a unit which can be pulled out of the pre-mixing chamber in the axial direction.

9. Burner system according to claim 1, wherein said fuel control device connected to the main fuel control valve and to the pilot fuel control valve and operating in response to the load signal device reduces the partial amount of the fuel fed to the pilot fuel nozzle with increasing load after the idling speed or a small partial load is reached.

10. Burner system according to claim 1, wherein the pre-mixing chamber has a venturi-like contour with a section converging at the upstream end and a section diverging at the downstream end, wherein the feeding device for combustion air which leads to the pre-mixing chamber is a swirling device and wherein the fuel feed line leading to the pilot fuel nozzle goes through the pre-mixing chamber centrally and in the axial direction.

* * * * *